US009461378B1

(12) United States Patent
Chen

(10) Patent No.: US 9,461,378 B1
(45) Date of Patent: Oct. 4, 2016

(54) CONNECTOR WITH IMPROVED STRUCTURE

(71) Applicant: SPEED TECH CORP., Taoyuan (TW)

(72) Inventor: Chih-Cheng Chen, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/955,061

(22) Filed: Dec. 1, 2015

(30) Foreign Application Priority Data

Jul. 20, 2015 (TW) ..... 104211713 U

(51) Int. Cl.
*H01R 13/648* (2006.01)
*H01R 12/51* (2011.01)
*H01R 13/6581* (2011.01)

(52) U.S. Cl.
CPC ..... *H01R 12/51* (2013.01); *H01R 13/6581* (2013.01)

(58) Field of Classification Search
CPC ..... H01R 13/6275; H01R 23/6873; H01R 12/707; H01R 13/65802; H01R 13/6581; H01R 12/716; H01R 13/6594; H01R 12/724
See application file for complete search history.

(56) References Cited

U.S. PATENT DOCUMENTS 7,108,554 B2 * 9/2006 Huang ..... H01R 23/6873 439/378
7,445,502 B2 * 11/2008 Zhang ..... H01R 13/6275 439/607.01
7,758,379 B2 * 7/2010 Chen ..... H01R 13/6485 439/607.11

FOREIGN PATENT DOCUMENTS

TW M484832 U 8/2014

OTHER PUBLICATIONS

Hua-Chun Chang, "Universal Serial Bus Connector", U.S. Appl. No. 14/667,677, filed Mar. 25, 2015.

* cited by examiner

*Primary Examiner* — Xuong Chung Trans
(74) *Attorney, Agent, or Firm* — CKC & Partners Co., Ltd.

(57) ABSTRACT

A connector with an improved structure is provided. The connector includes an insulating shell, a shielding shell and plural terminals. The terminals are received in the insulating shell. Each terminal has a contact portion and a connecting portion exposed from the insulating shell. The contact portion of each terminal is capable of transmitting an electrical signal with a docking connector. The connecting portion of each terminal is welded to the circuit board. The insulating shell is received in the shielding shell. The shielding shell has an opening, such that the connector is capable of mating the connector with the docking connector, and two sides of the opening of the shielding shell extend toward the circuit board to form at least one welding pin fixed on the circuit board.

7 Claims, 11 Drawing Sheets

CONNECTOR WITH IMPROVED STRUCTURE

RELATED APPLICATIONS

This application claims priority to Taiwan Application Serial Number 104211713, filed on Jul. 20, 2015, which is herein incorporated by reference.

BACKGROUND

1. Field of Disclosure

The present disclosure relates to a connector with an improved structure, and more particularly to a vertical type connector of which a metal shell has a monolithic appearance, in which the welding pins extending from two sides of the metal shell can be used to enhance the stability of welding structures of the vertical type connector installed on a circuit board.

2. Description of Related Art

With the trend of minimization of an electronic device, the overall volume of a connector is required to be shrunk correspondingly. For facilitating shrinking the area of the connector on an internal circuit board of the electronic device, the connector generally adopts a vertical type structure placed on the internal circuit board. For matching and conducting with a docking device, the connector has to be docked with the docking device. However, with the cumulatively increasing number of docking times when a mass production test is performed, the vertical type structure cannot effectively resist the impact pressure generated from the mutual contact with the docking device due to its tiny surface area, thus easily causing welding pins of the connector to be detached from the internal circuit board. In order to enhance the strength of the overall structure after the vertical type connector is placed on the circuit board, the number of the welding pins is often increased. However, the method of increasing the welding pins is often limited by a circuit configuration which desires to keep the welding pins away from other signal pins on the circuit board, and thus the size of the structure is greatly increased, and the height of the structure is increased as well. Additional components are even added to achieve support effect, and thus a lot of extra cost is caused, and the external structure becomes bigger and taller, which does not meet the customers' product requirements of thinness, shortness, lightness, and smallness.

As shown in FIG. 17, Taiwan Patent Number M484832 provides a connector including an insulating shell A1, a first group of terminals A2, a second group of terminals A3, a shielding shell A4 and at least one partition plate A5. The first group of terminals A2 and the second group of terminals A3 are received in the insulating shell A1, and the insulating shell A1 is received in the shielding shell A4.

In the disclosure of the aforementioned prior art, a body portion A11 is disposed on the insulating shell A1, and a tongue portion A12 is formed extending outwards from the body portion A11, and the partition plate A5 is fixed between the body portion A11 and the tongue portion A12. The first group of terminals A2 and the second group of terminals A3 are shielded and isolated from the insulating shell A1 by the partition plate A5, i.e. the partition plate A5 is used to reinforce the shielding and isolation of the electromagnetic radiation between the first group of terminals A2 and the second group of terminals A3. Further, the shielding shell A4 is a frame structure formed by using a stamping process to cut, bend and fold a metal thin plate; the insulating shell A1 is received and disposed in the shielding shell A4; and two non-adjacent surfaces of the shielding shell A4 extend downwards to a circuit board (not shown) to form solder plates A13 respectively.

In the disclosure of the aforementioned prior art, because each of the solder plates A13 of the two non-adjacent surfaces of the shielding shell A4 is formed from one single thin flat plate, such a design cannot increase the welding strength after the circuit board (not shown) is disposed. Therefore, when a durability test of assembly is performed for the connector with a docking device (not shown), the solder plates A13 of the connector are likely to be detached and separated from the circuit board (not shown), thus failing to effectively promoting the overall structural stability of the product, further resulting in a production issue to be resolved.

SUMMARY

A main object of the present disclosure is to provide a connector with an improved structure, in which an external shielding shell of the connector has at least one welding pin disposed thereon, and the welding pin is located at the circuit board, thereby forming minimum space to achieve maximum structural strength.

The present disclosure mainly directs to a connection with an improved structure. The connector is suitable for being welded to a circuit board, and the connector includes an insulating shell, a shielding shell and plural terminals. Each terminal is received in the insulating shell. Each terminal has a contact portion and a connecting portion exposed from the insulating shell. The contact portion of each terminal is configured to communicate an electrical signal with a docking connector. The connecting portion of each of the terminals is welded to the circuit board, and the insulating shell is received in the shielding shell. Wherein, the shielding shell has an opening for allowing the connector to be docked with the docking connector, and two sides of the opening of the shielding shell extend towards the circuit board to form at least one welding pin fixed on the circuit board.

The connector of the present disclosure belongs to a vertical type connector in which the opening of the shielding shell faces towards the direction away from the circuit board, i.e. the opening and the circuit board are located at opposite directions. The terminals consist of plural first terminals and plural second terminals. Each connecting portion of the first terminals and the second terminals is arranged on the same plane for conveniently being welded to the circuit board. Further, a grounding plate is fixed on the insulating body for isolating electromagnetic radiation between the first terminals and the second terminals, such that the signals at the first terminals and the second terminals do not interfere with each other.

In the present disclosure, the shielding shell is monolithically formed by using a stamping process to perform cutting and being operations, for enhancing shielding and isolation of electromagnetic radiation generated when the connector is electrically conducted. The opening of the shielding shell extends outwards from the circuit board to form at least one welding pin fixed on the circuit board. The shielding shell with the monolithically formed structure can enhance its reliability and stability when installed on the circuit board. Further, two sides of the insulating shell extend outwards respectively to form a supporting base which has a groove. A folded plate is formed between the opening and the welding pin, and the folded plate is received in the groove.

Other applications of the present disclosure will become obvious by reference to the following detailed description of the present disclosure. However, in the present disclosure, at least one welding pin of the shielding shell is located at the circuit board, thereby enhancing the stability of the upper plate of the connector. Further, the whole shielding shell is monolithically formed, thereby simplifying its fabricating processes and reducing its manufacturing cost. Other methods with the same theory designed by those skilled in the art are still in the scope of the present disclosure.

DETAILED DESCRIPTION

Figure 1:
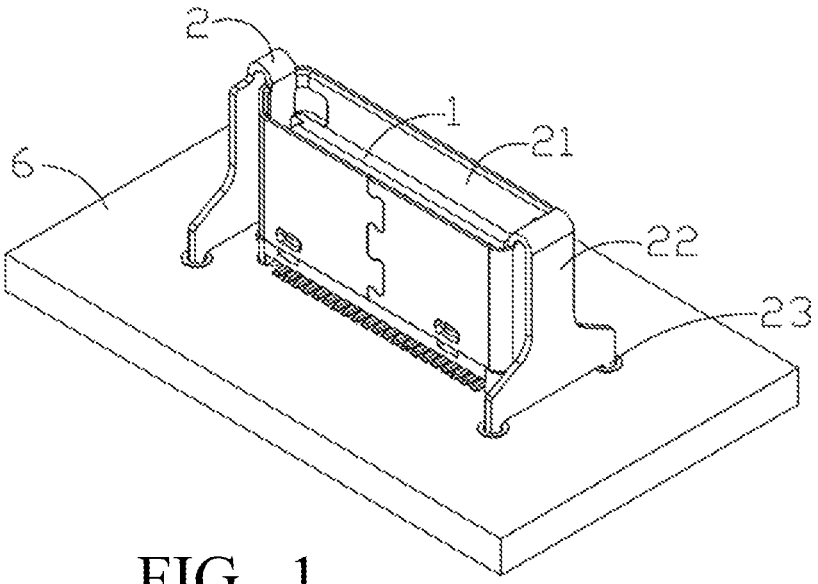
FIG. 1 is a 3-D appearance view of a first embodiment of the present disclosure viewed from a first viewing angle.
Figure 2:
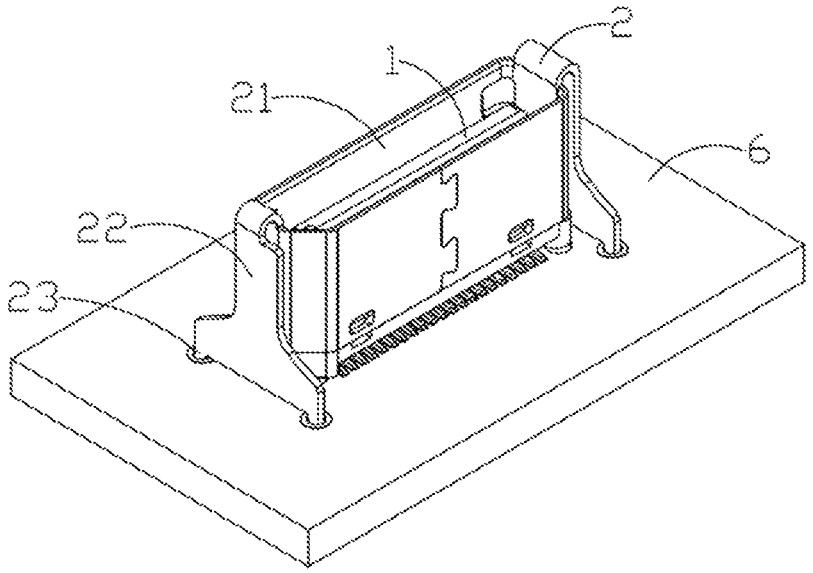
FIG. 2 is a 3-D appearance view of the first embodiment of the present disclosure viewed from a second viewing angle.
Figure 3:
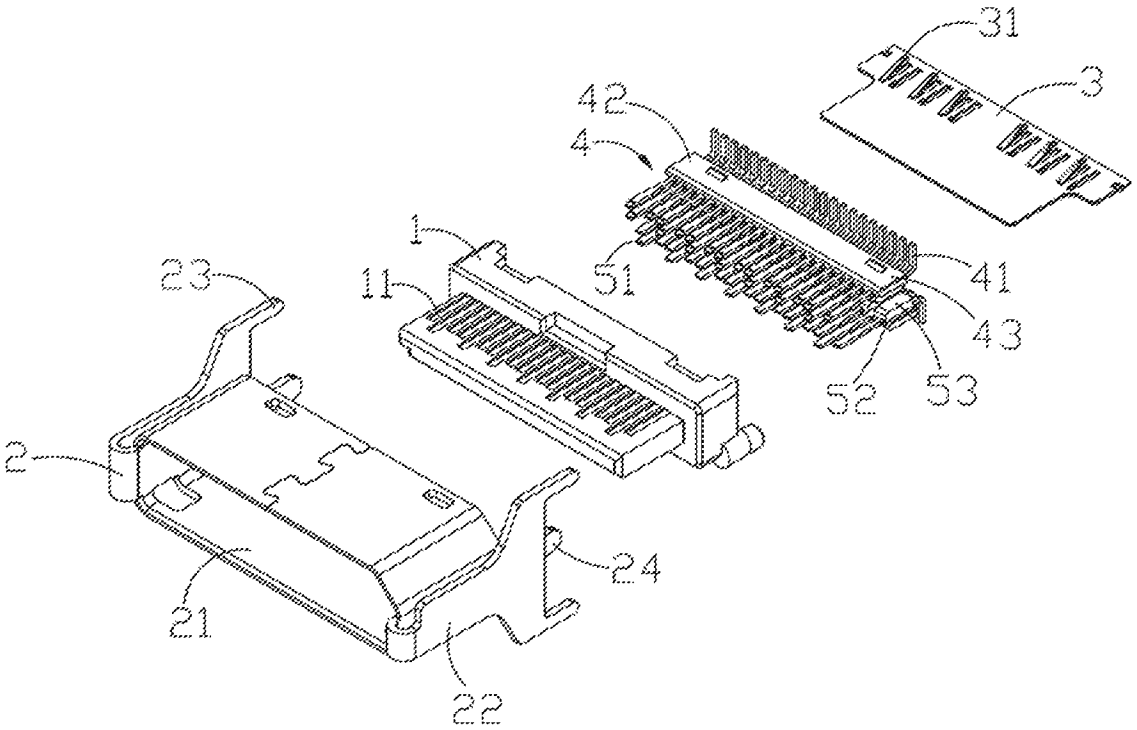
FIG. 3 is a 3-D exploded view of the first embodiment of the present disclosure viewed from the first viewing angle.
Figure 4:
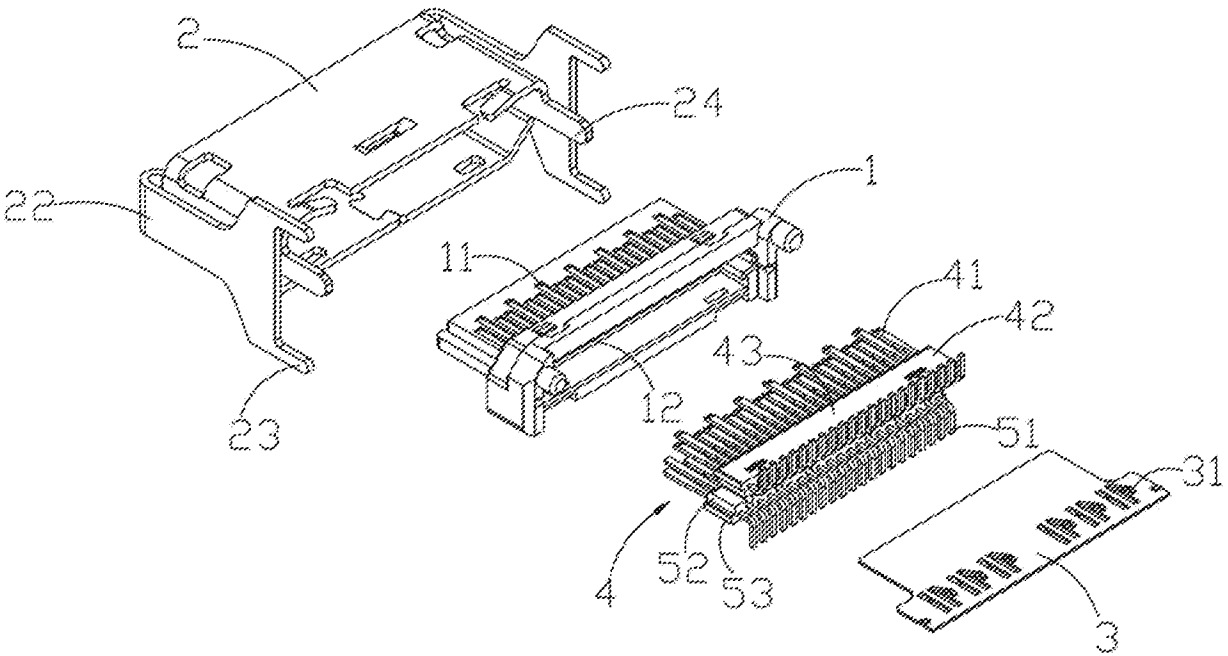
FIG. 4 is a 3-D exploded view of the first embodiment of the present disclosure viewed from the second viewing angle.
Figure 5:
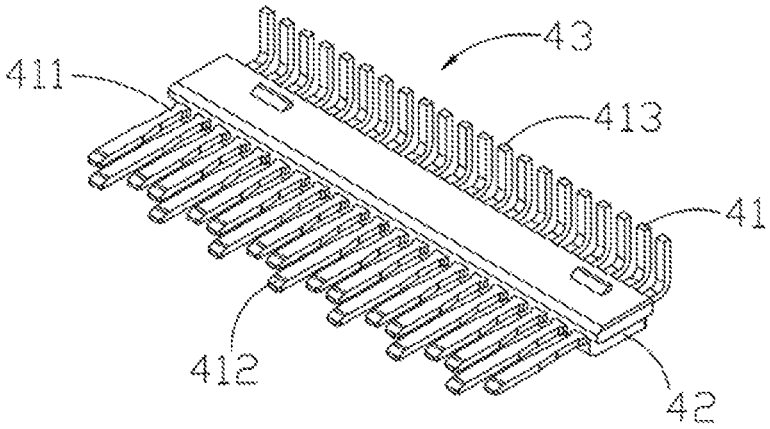
FIG. 5 is a 3-D exploded view of a first component of the connector of the first embodiment of the present disclosure.
Figure 6:
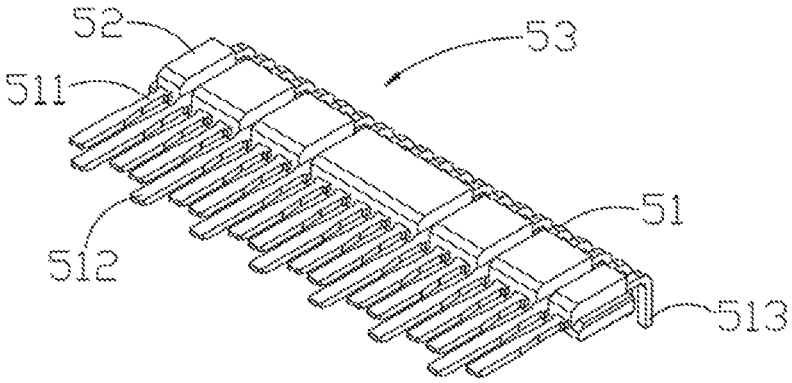
FIG. 6 is a 3-D exploded view of a second component of the connector of the first embodiment of the present disclosure.
Figure 7:
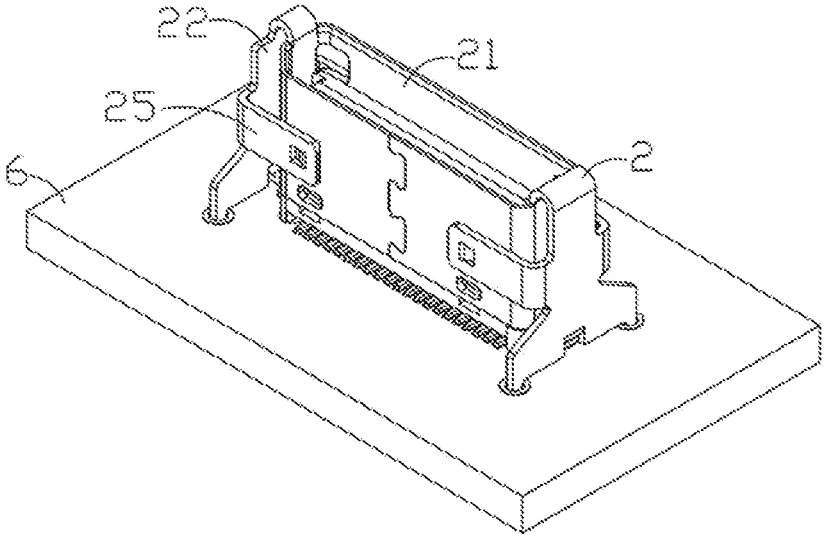
FIG. 7 is a 3-D appearance view of a second embodiment of the present disclosure viewed from a first viewing angle.
Figure 8:
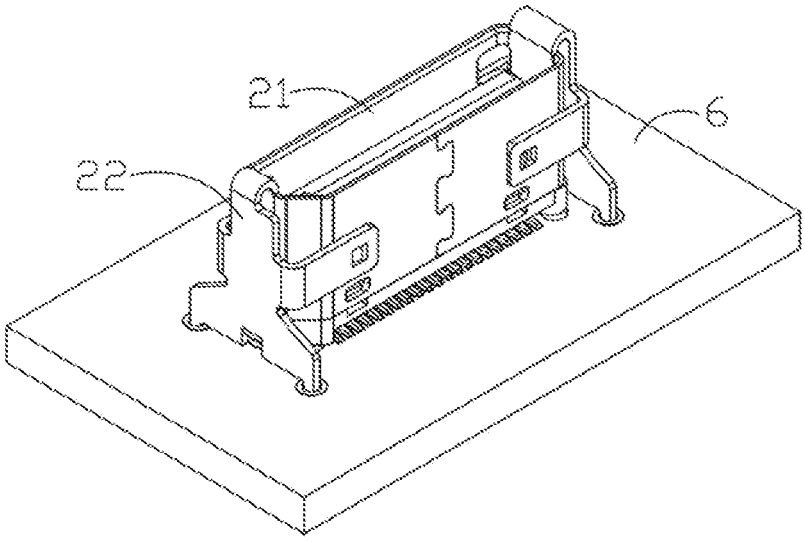
FIG. 8 is a 3-D appearance view of the second embodiment of the present disclosure viewed from a second viewing angle.
Figure 9:
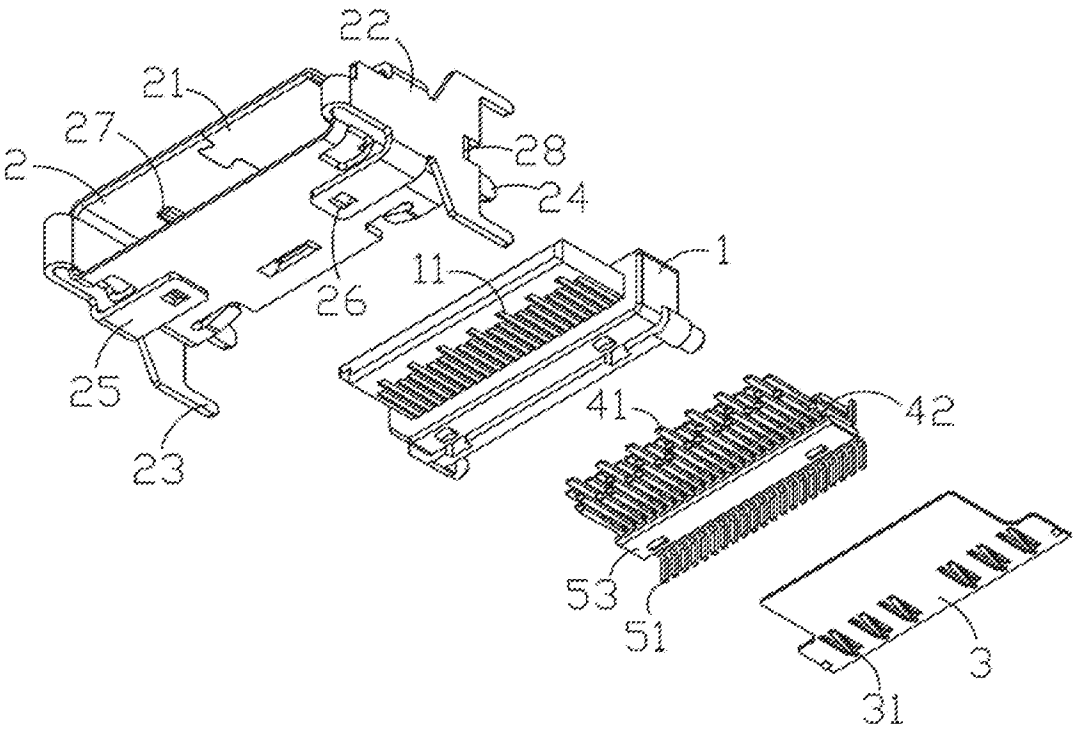
FIG. 9 is a 3-D exploded view of the second embodiment of the present disclosure viewed from the first viewing angle.
Figure 10:
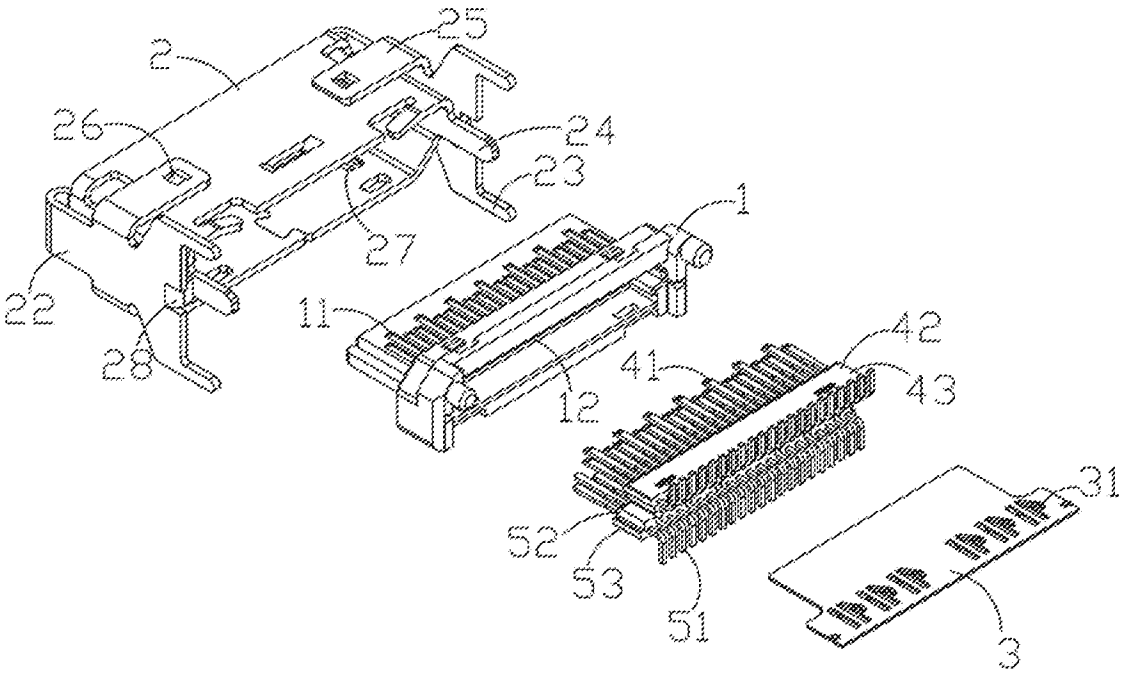
FIG. 10 is a 3-D exploded view of the second embodiment of the present disclosure viewed from the second viewing angle.

A connector with an improved structure in a first embodiment of the present disclosure is shown in FIGS. 1-4. The connector adopts a vertical type structure placed on a circuit board 6, and includes an insulating shell 1, a shielding shell 2 and plural terminals 4. The insulating shell 1 has a grounding plate 3. The terminals 4 and the grounding plate 3 are received in the insulating shell 1. The insulating shell 1 is received in the shielding shell 2. The terminals 4 are composed of plural first terminals 41 and plural second terminals 51 respectively. The first terminals 41 are assembled on a first module 42 to form a first component 43, and the second terminals 51 are assembled on a second module 52 to form a second component 53, in which the first component 43 and the second component 53 are received in the insulating shell 1. Further, the shielding shell 2 has an opening 21 for allowing the connector to be docked with a docking connector (not shown). The opening 21 of the shielding shell 2 of the vertical type connector faces towards the direction away from the circuit board 6, i.e. the opening 21 and the circuit board 6 are located at opposite directions.

As shown in FIGS. 1-6, in the first embodiment of the present disclosure, two sides of the opening 21 are folded outwards by 180 degrees respectively and then extend in parallel to form first folded plates 22. Each first folded plate 22 extends towards the circuit board 6, and has at least one welding pin 23. In the present disclosure, the shielding shell 2 includes plural welding pins 23, and the distance between the welding pins 23 is greater than the width of each first folded plate 22. Each welding pin 23 extends downwards to the circuit board 6, and is located at the circuit board 6. Because the distance between the welding pins 23 is greater than the width of each first folded plate 22, the stability of the bottom of the shielding shell 2 can be effectively enhanced. Further, the left and right sides of the shielding shell 2 extend downwards respectively to form welding portions 24 for assisting the shielding shell 2 to be positioned at the circuit board 6.

As shown in FIGS. 1-6, in the first embodiment of the present disclosure, each first terminal 41 is composed of a first fixing portion 411, a first contact portion 412 and a first connecting portion 413, and each first fixing portion 411 is partially inserted in the first module 42 by insert molding. Each second terminal 51 is composed of a second fixing portion 511, a second contact portion 512 and a second connecting portion 513, and each second fixing portion 511 is partially inserted in the second module 52 by insert molding. Each first contact portion 412, each second contact portion 512, each first connecting portion 413 and each second connecting portion 513 are exposed from the insulating shell 1. The insulating shell 1 has accommodation slots 11, and the first contact portion 412 of each first terminal 41 and the second contact portion 512 of each second terminal 51 are respectively received in the accommodation slots 11. The first contact portion 412 of each first terminal 41 and the second contact portion 512 of each second terminal 51 can communicate electrical signals with a docking connector (not shown). Each first connecting portion 413 and each second connecting portion 513 are respectively connected to the circuit board 6, and each first connecting portion 413 and each second connecting portion 513 are arranged on the same plane for being welded to the circuit board 6 conveniently.

As shown in FIGS. 1-6, in the first embodiment of the present disclosure, the grounding plate 3 has plural grounding terminals 31, and the grounding plate 3 is used to shield and isolate electromagnetic radiation generated between the first terminals 41 and the second terminals 51. By using the grounding plate 3 to distinguish and isolate electrical signal communication between the first terminals 41 and the second terminals 51, the signals at the first terminals 41 and the second terminals 51 do not interfere with each other and thus do not affect electrical data transmission. The grounding terminals 31 partially contact the first terminals 41 and the second terminals 51 respectively. In the present disclosure, the first terminals 41 and the second terminals 51 with a longer terminal length may partially contact the grounding terminals 31 respectively, such that each first terminal 41 and each second terminal 51 can release ground signals to the grounding plate 3. Further, the insulating shell 1 has a grounding slot 12 for receiving the grounding plate 3, thereby enabling the grounding terminals 31 to be positioned at the grounding slot 12. The shielding shell 2 is monolithically formed by using a stamping process and a mechanical sheet metal method to cut, bend and fold a metal thin plate for enhancing shielding and isolation of electromagnetic radiation generated when the connector is electrically conducted. The shielding shell 2 with the monolithically formed structure can enhance its reliability and stability on the circuit board 6.

As shown in FIGS. 7-10, in the second embodiment of the present disclosure, central portions of two sides of each first folded plate 22 properly extend towards central portions of the shielding shell 2 to form retaining plates 25 respectively. The retaining plates 25 cover the front and rear portions of the shielding shell 2, i.e. the retaining plates 25 and the shielding shell 2 are tightly attached. Each retaining plate 25 has a retaining point 26 located near the central portion of the shielding shell 2, and the retaining point 26 is formed by concaving a portion of the retaining plate 25. The shielding shell 2 has engaging parts 27 disposed at corresponding positions, and the retaining points 26 can be retained at the engaging parts 27 respectively. The retaining plates 25 can also be laser-welded on the shielding shell 2 for enhancing the stability of the shielding shell 2 under a lateral threat tolerance test, thereby providing products with high reliability to customers. Further, a fixing block 28 is further disposed on the bottom of each first folded plate 22. The fixing blocks 28 extend towards the shielding shell 2, and support and resist the shielding shell 2, thereby assisting the first folded plates 22 to be combined with the shielding shell 2.

Figure 11:
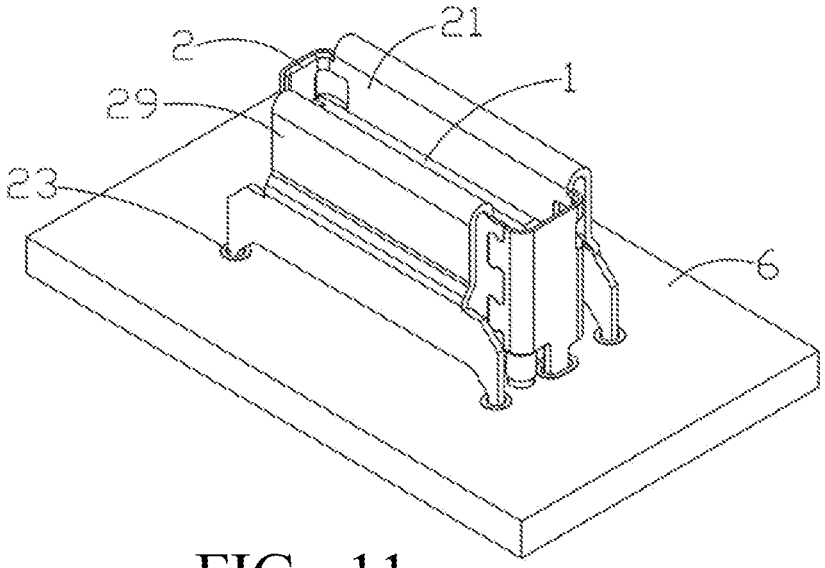
FIG. 11 is a 3-D appearance view of a third embodiment of the present disclosure viewed from a first viewing angle.
Figure 12:
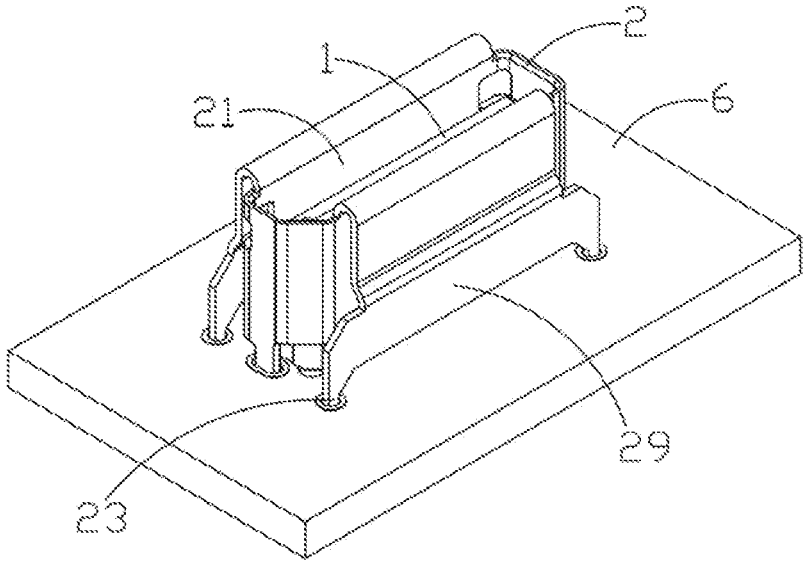
FIG. 12 is a 3-D appearance view of the third embodiment of the present disclosure viewed from a second viewing angle.

As shown in FIGS. 11 and 12, in the third embodiment of the present disclosure, two sides of the opening 21 of the shielding shell 2 parallel to the insulating shell 1 are folded outwards by 180 degrees, and then extend to form second folded plates 29 respectively. Each second folded plate 29 extends toward the circuit board 6, and has at least one welding pin 23. In the present disclosure, plural welding pins 23 are disposed, and the distance between two adjacent welding pins 23 is greater than the width of each second folded plate 29. Each welding pin 23 extends downwards to the circuit board 6, and is welded and positioned at the circuit board 6. Because the distance between the two adjacent welding pins 23 is greater than the width of each second folded plate 29 itself, the stability of the bottom of the shielding shell 2 can be effectively enhanced.

Figure 13:
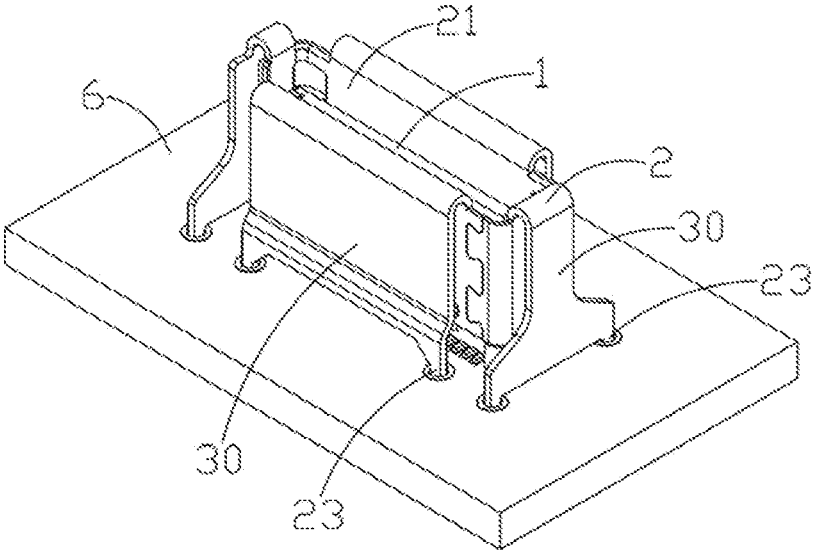
FIG. 13 is a 3-D appearance view of a fourth embodiment of the present disclosure viewed from a first viewing angle.
Figure 14:
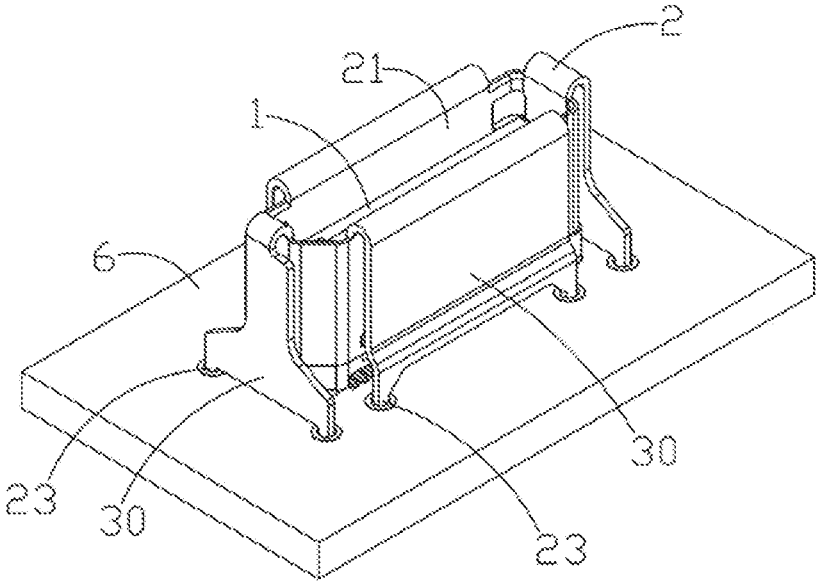
FIG. 14 is a 3-D appearance view of the fourth embodiment of the present disclosure viewed from a second viewing angle.

As shown in FIGS. 13 and 14, in the fourth embodiment of the present disclosure, the peripheries of the opening 21 of the shielding shell 2 are folded outwards by 180 degrees, and extend to form third folded plates 30 respectively. Each third folded plate 30 extends toward the circuit board 6, and has at least one welding pin 23. Each welding pin 23 is welded and positioned at the circuit board 6.

Figure 15:
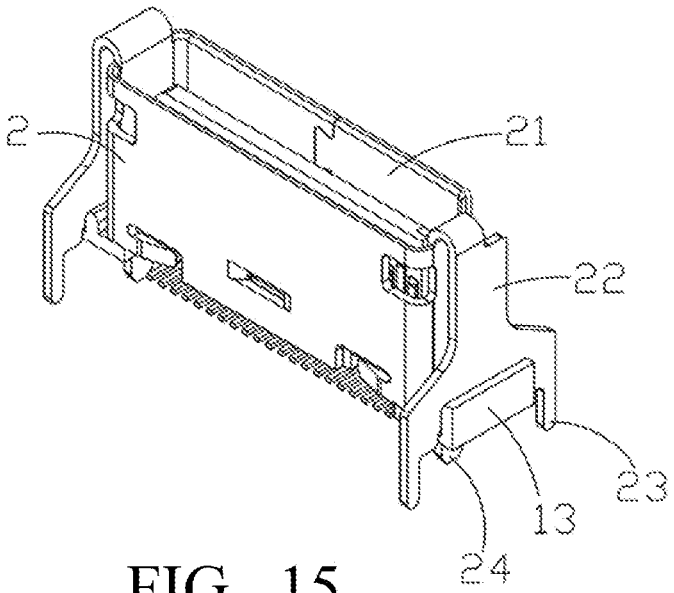
FIG. 15 is a 3-D appearance view of a fifth embodiment of the present disclosure viewed from a first viewing angle.
Figure 16:
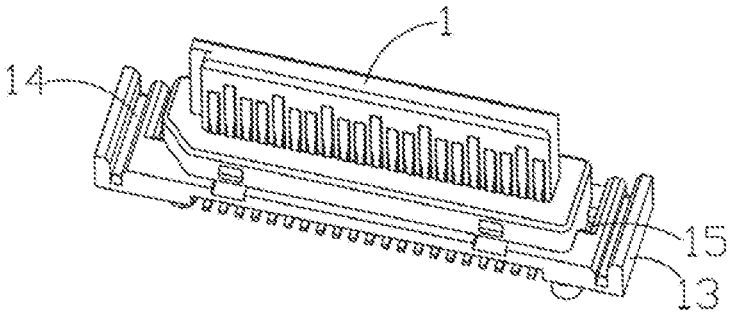
FIG. 16 is a partial 3-D appearance view of the fifth embodiment of the present disclosure viewed from a second viewing angle.
Figure 17:
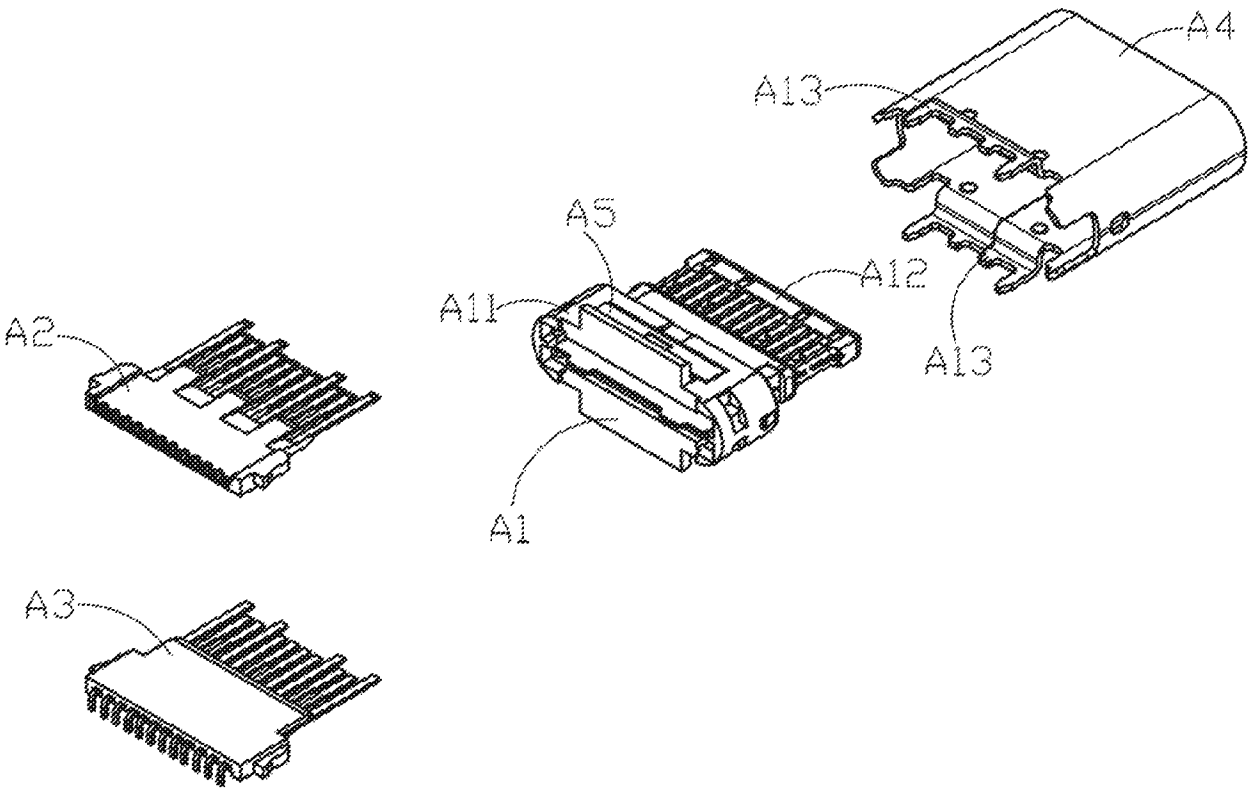
FIG. 17 (Prior Art)
FIG. 17 is a 3-D exploded view of a connector disclosed by Taiwan Patent Number M484832.

As shown in FIGS. 15 and 16, in the fifth embodiment of the present disclosure, two sides of the insulating shell 1 extend outwards to form L-shaped supporting bases 13 respectively. The center of each supporting base 13 has a groove 14. The first folded plates 22 are formed between the opening 21 and the welding pins 23 and are received in the grooves 14 respectively. Further, an aperture 15 is concavely formed between each supporting base 13 and the insulating shell 1. The welding portion 24 of the shielding shell 2 may pass through the apertures 15 respectively and be fixed on the circuit board (not shown). With the grooves 14 and the apertures 15, the stability of the shielding shell 2 and the insulating shell 1 which are assembled to each other can be enhanced.

It will be apparent to those skilled in the art that various modifications and variations can be made to the structure of the disclosure without departing from the scope or spirit of the present disclosure. In view of the foregoing, it is intended that the present disclosure cover modifications and variations of this disclosure provided they fall within the scope of the following claims.

What is claimed is:

1. A connector suitable for being welded to a circuit board, and the connector comprising an insulating shell, a shielding shell and a plurality of terminals, wherein each of the terminals are received in the insulating shell; each of the terminals has a contact portion and a connecting portion exposed from the insulating shell; the contact portion of each of the terminals is configured to communicate an electrical signal with a docking connector; the connecting portion of each of the terminals is welded to the circuit board; and the insulating shell is received in the shielding shell;

wherein the shielding shell has an opening for allowing the connector to be docked with the docking connector, and two sides of the opening of the shielding shell are folded outwards by 180 degrees respectively and extend to form a folded plate, and the folded plate extends towards the circuit board to form at least one welding pin.

2. The connector of claim 1, wherein the shielding shell is monolithically formed by using a stamping process to perform cutting and bending operations.

3. The connector of claim 1, wherein the connector is a vertical type connector, and the opening of the shielding shell of the vertical type connector faces towards a direction away from the circuit board.

4. The connector of claim 1, wherein the terminals are composed of a plurality of first terminals and a plurality of second terminals, wherein the connecting portions of the fast terminals and the second terminals are arranged on the same plane.

5. The connector of claim 4, wherein the insulating shell is fixed on a grounding plate used for isolating electromagnetic radiation between the first terminals and the second terminals.

6. The connector of claim 1, wherein the opening of the shielding shell faces towards the circuit board to form at least one welding pin.

7. The connector of claim 1, wherein two sides of the insulating shell extend outwards respectively to form a supporting base, wherein the supporting base has a groove, and the folded plate is received in the groove.

* * * * *